United States Patent [19]

Simmons et al.

[11] Patent Number: 4,997,995

[45] Date of Patent: Mar. 5, 1991

[54] EXTRA-HIGH-VOLTAGE POWER CABLE

[75] Inventors: Malcolm A. Simmons, Whiteparish; Julian G. Head, Chandlers Ford, both of England

[73] Assignee: Pirelli General plc, London, England

[21] Appl. No.: 421,175

[22] Filed: Oct. 13, 1989

[30] Foreign Application Priority Data

Oct. 17, 1988 [GB] United Kingdom ..... 8824285

[51] Int. Cl.[5] ..... H01B 9/02

[52] U.S. Cl. ..... 174/120 SC; 156/51; 174/120 SR; 264/174

[58] Field of Search ..... 174/120 R, 120, SC, 174/120 SR, 110 PM; 156/51; 264/174

[56] References Cited

U.S. PATENT DOCUMENTS

| | | | |
|---|---|---|---|
| 2,717,917 | 9/1955 | Isenberg | 174/121 R |
| 2,877,500 | 3/1959 | Rainer et al. | 174/110 PM |
| 3,580,987 | 5/1971 | Priaroggia | 174/120 SR |
| 3,711,631 | 1/1973 | Denes | 174/120 R X |
| 4,104,481 | 8/1978 | Wilkenloh et al. | 174/110 PM X |
| 4,132,858 | 1/1979 | Anderson et al. | 174/120 R X |
| 4,310,597 | 1/1982 | Checkland et al. | 174/120 SR X |
| 4,604,497 | 8/1986 | Bell et al. | 174/110 F |

FOREIGN PATENT DOCUMENTS

| | | |
|---|---|---|
| 831848 | 7/1949 | Fed. Rep. of Germany . |
| 2004717 | 11/1969 | France . |
| 813554 | 9/1957 | United Kingdom . |
| 1194750 | 12/1967 | United Kingdom . |
| 1237173 | 6/1971 | United Kingdom . |
| 1403960 | 8/1975 | United Kingdom . |
| 2127612 | 4/1984 | United Kingdom ..... 174/120 SR |
| 2165689 | 4/1986 | United Kingdom . |

*Primary Examiner*—Morris H. Nimmo

*Attorney, Agent, or Firm*—Brooks Haidt Haffner & Delahunty

[57] ABSTRACT

An extra-high-voltage power cable is provided with extruded insulation 3 over a conductor 1 thereof. The insulation comprises an inner layer 5 of an unfilled high density polyethylene or polypropylene material having a higher electric strength than the material of the insulation adjacent thereto in an outer layer 6 thereof.

12 Claims, 1 Drawing Sheet

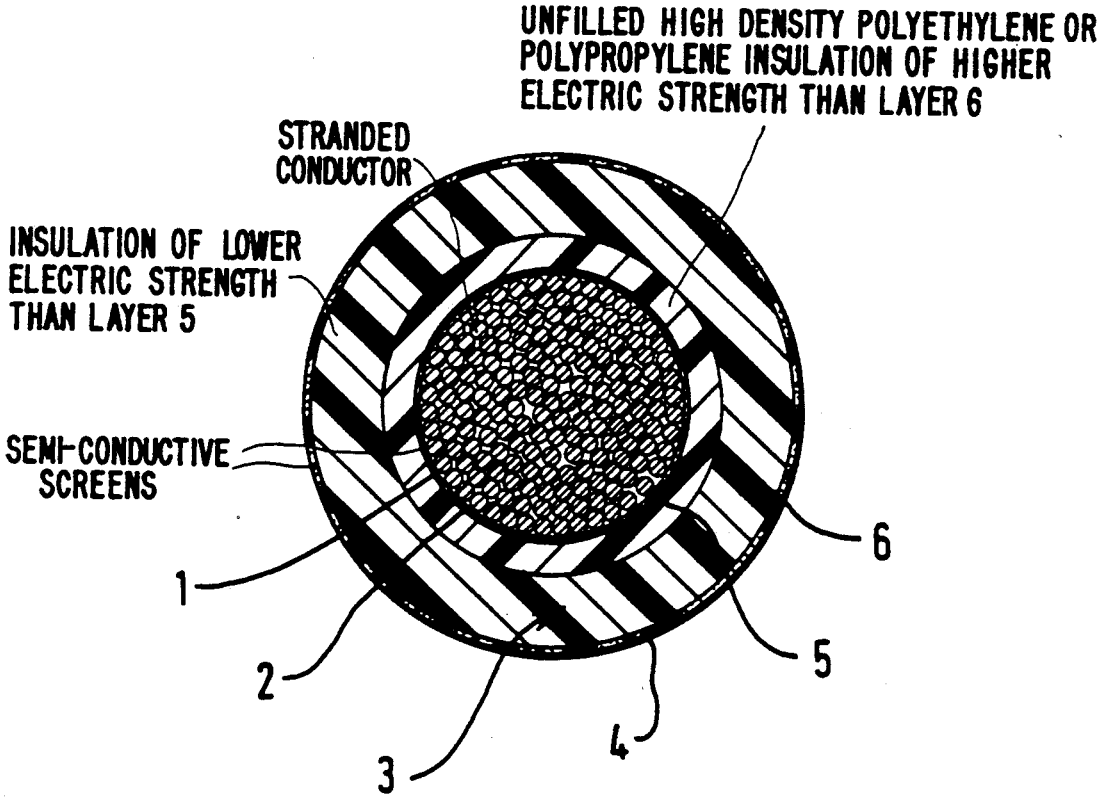
UNFILLED HIGH DENSITY POLYETHYLENE OR POLYPROPYLENE INSULATION OF HIGHER ELECTRIC STRENGTH THAN LAYER 6
STRANDED CONDUCTOR
INSULATION OF LOWER ELECTRIC STRENGTH THAN LAYER 5
SEMI-CONDUCTIVE SCREENS
1
2
3
4
5
6

EXTRA-HIGH-VOLTAGE POWER CABLE

This invention relates to extra-high-voltage power cables, that is power cables for voltages of 132 kV and above, which are provided with extruded insulation over their conductors.

Currently cables up to and including 275 kV are being provided with extruded insulation comprising crosslinked low density polyethylene. However the use of such material for cables of higher voltages, for example 400 kV, requires the insulation to have a thickness which would result in unacceptable increases in the cable diametral dimensions both as regards to production and installation and, of course, material costs for the components of the cable radially outwardly of the insulation.

In order to reduce the thickness of extruded insulation of cables it is known to form the insulation in layers which are graded according to their dielectric constant (also referred to as permittivity or specific inductive capacitance (sic)), with the inner layer of the insulation (wherein the electric stress will be higher) having a higher dielectric constant than the rest of the insulation, Examples of cables having such dielectric constant graded insulation layers are disclosed in US2717917, GB 2165689, GB 1194750 and US 4132858. US 3711631 discloses extruded insulation formed in layers which are graded according to a so-called 'strength constant' which is defined as the product of the dielectric constant and the maximum allowable dielectric stress.

We have found that for extra-high-voltage cables it is more important to grade the layers of the insulation according to their electric strength rather than their dielectric constant or so-called 'strength constant'. In this connection it will be appreciated that in general increasing the dielectric constant of the material by adding appropriate fillers will give rise to a decrease in its electric strength and may result in a change in the 'strength constant' in either direction.

The present invention accordingly provides a method of manufacturing an extra-high-voltage cable including extruding over a conductor of the cable at least two layers of insulation wherein the material for the inner layer is selected by virtue of its higher electric strength than the remainder of the insulation.

The invention also includes an extra-high-voltage power cable provided with extruded insulation over a conductor thereof, said insulation comprising an inner layer of an unfilled high density polyethylene or polypropylene material having a higher electric strength than the material of the insulation adjacent thereto.

The electric strength of the material of said inner layer may be at least 50 percent greater than that of the material of the insulation adjacent thereto.

Whilst the material of said inner layer may be crosslinked it may also be un-crosslinked.

The material of the insulation adjacent the inner layer may comprise a crosslinked low density polyethylene, i.e. a material currently commonly used for the whole of the extruded insulation.

The thickness of the inner layer is preferably no more than a third of the thickness of the extruded insulation.

In a preferred embodiment, the insulation comprises two layers.

The invention also includes a method of manufacturing an extra-high-voltage cable including the step of extruding insulation over a conductor of the cable such that the insulation has an inner layer of an unfilled high density polyethylene or polypropylene material having a higher electric strength than the material of the insulation adjacent thereto.

Preferably the inner layer is extruded over the conductor upstream of the material of the insulation adjacent to the inner layer being extruded over the inner layer, such that the interface between the inner layer and a screen over the conductor may be optically inspected through the inner layer prior to the material of the insulation adjacent to the inner layer being extruded over the inner layer.

In order that the invention may be well understood, an embodiment thereof, which is given by way of example only, will now be described with reference to the accompanying drawing in which the single figure is a schematic cross-sectional view of a core of a 400 kV cable.

The core illustrated in the drawing comprises a central stranded conductor 1 an extruded, semiconducting screen layer 2 over the conductor, extruded insulation 3 over the screen layer 2 and an extruded semiconducting screen layer 4 over the extruded insulation 3. As thus far described the construction of the core is the same as that for a conventional 275 kV cable having extruded insulation. However, in the illustrated embodiment the extruded insulation 3 comprises an inner layer 5 and an outer layer 6. The inner layer is of a material selected for having a higher electric strength than the material of the outer layer 6.

In the embodiment the material of the outer layer comprises a crosslinked low density polyethylene such as that presently conventionally used for the whole of the extruded insulation of conductor cores in 275 kV cables. The material of the inner layer in the embodiment is a high density polyethylene or a polypropylene and has an electric strength which is at least 30, and preferably at least 50%, greater than that of the crosslinked low density polyethylene of the outer layer. By utilising material with higher electric strength in the inner layer of the extruded insulation the overall thickness of the extruded insulation can be significantly reduced as compared with the thickness required if the insulation comprised crosslinked low density polyethylene throughout.

The thickness of the inner layer 5 is not as great as the thickness of the outer layer 6 and is preferably no more than about $\frac{1}{3}$ of the thickness of the extruded insulation. The inner layer 5 need not be crosslinked as the form stability of the insulation is maintained by the greater thickness of the crosslinked outer layer. Furthermore, the bending stiffness of the extruded insulation is largely dependent upon the lower density polyethylene outer layer rather than the high density polyethylene or polypropylene inner layer and accordingly the flexibility of the core may be greater than that of a corresponding core where the extruded insulation comprises low density polyethylene throughout and accordingly has a greater thickness.

The material of the inner layer is unfilled and accordingly translucent when being extruded. This is of particular advantage in that if the inner layer 5 is extruded upstream of the outer layer 6 it is possible to optically inspect through the inner layer the interface between the inner layer and the inner screen layer 2 prior to the outer layer 6 being extruded over the inner layer 5. In this way the interface can be checked for imperfections which may give rise to electrical breakdown. Thus in a preferred method of producing the illustrated core, the inner layer 5 is extruded onto or with the screen layer 2, the interface between the layers 5 and 2 are optically inspected and subsequently the layer 6 is extruded, possibly together with the screen layer 4, over the inner layer 5.

It will of course be appreciated that subsequent to the manufacture of the core illustrated, that core would be provided with conventional outer layers. It will also be appreciated that although particularly applicable to 400 kV cables, the present invention is also advantageous in connection with other extra-high-voltage cables in that it enables the thickness of the extruded insulation to be reduced.

We claim:

1. An extra-high-voltage electric power cable comprising:

a conductor;

a first at least semi-conductive screen around and contacting said conductor;

an inner first insulating layer of an unfilled high density polyethylene or polypropylene material having a predetermined electric strength around said semi-conductive screen;

at least a second insulating layer around said first insulating layer, sad second insulating layer having an electric strength less than said predetermined electric strength of said first insulating layer; and, a second at least semi-conductive screen around said second insulating layer.

2. A cable as claimed in claim 1 wherein said predetermined electric strength of said first insulating layer is at least fifty percent greater than said electric strength of said second insulating layer.

3. A cable as claimed in claim 1 or 2 wherein said material of said first insulating layer is cross-linked.

4. A cable as claimed in claim 1 or 2 wherein said material of said first insulating layer is un-cross-linked.

5. A cable as claimed in claim 1 or 2 wherein said material of said second insulating layer is cross-linked, low density polyethylene.

6. A cable as claimed in claim 12 or 13 wherein each insulating layer is extruded and wherein the radial thickness of said first insulating layer is no greater than one-third of the combined radial thicknesses of the extruded insulating layers.

7. A cable as claimed in claim 1 or 2 wherein said first insulating layer and said second insulating layer are in contact with each other.

8. A cable as claimed in claim 7 wherein said first insulating layer is in contact with said first screen and said second screen is in contact with said second insulating layer.

9. A method of manufacturing an extra-high voltage cable having a conductor, said method comprising:

extruding a first layer of semi-conductive plastic material over said conductor;

extruding an insulating second layer of unfilled high density polyethylene or polypropylene material having a predetermined electric strength over said first layer;

extruding a third layer of an insulating material over said second layer, the last-mentioned said material having an electric strength less than said predetermined electric strength of said material of said second layer; and, extruding a further layer of semi-conductive plastic material over said third layer.

10. A method as claimed in claim 9 wherein said third layer is extruded over said second layer after said second layer has been extruded over said first layer to permit optical inspection of said first layer through said second layer prior to the extrusion of said third layer over said second layer.

11. A method of manufacturing an extra-high-voltage cable having a conductor, said method comprising:

extruding a first layer of a semi-conductive plastic material over said conductor;

extruding an insulating second layer of unfilled high density polyethylene or polypropylene material having a predetermined electric strength over an din contact with said first layer;

optically inspecting the interface between said first layer and said second layer through said second layer; and, after optically inspecting said interface, extruding a third layer of an insulating material over said second layer, the last-mentioned said material having an electric strength less than said predetermined electric strength of said material of said second layer.

12. A method as claimed in claim 11 wherein said material of said second layer is at least translucent to permit optical inspection of said interface.

* * * * *